US007637783B2

(12) United States Patent
Sasaoka et al.

(10) Patent No.: US 7,637,783 B2
(45) Date of Patent: Dec. 29, 2009

(54) CONTACT MEMBER HAVING MULTIPLE CONTACT PARTS AND CONNECTOR INCLUDING SAME

(75) Inventors: Chiharu Sasaoka, Iiyama (JP); Hideo Miyazawa, Shinagawa (JP); Mitsuru Kobayashi, Shinagawa (JP); Koki Sato, Shinagawa (JP); Akira Tamura, Kawasaki (JP); Koji Ishikawa, Kawasaki (JP); Yasushi Masuda, Kawasaki (JP)

(73) Assignees: Fujitsu Component Limited, Tokyo (JP); Fujitsu Limited, Kawasaki (JP)

( * ) Notice: Subject to any disclaimer, the term of this patent is extended or adjusted under 35 U.S.C. 154(b) by 0 days.

(21) Appl. No.: 12/185,145

(22) Filed: Aug. 4, 2008

(65) Prior Publication Data

US 2009/0209142 A1 Aug. 20, 2009

(30) Foreign Application Priority Data

Feb. 19, 2008 (JP) ..... 2008-037782

(51) Int. Cl.
*H01R 24/00* (2006.01)

(52) U.S. Cl. ..... 439/637; 439/862; 439/947

(58) Field of Classification Search ..... 439/637, 439/862, 947

See application file for complete search history.

(56) References Cited

U.S. PATENT DOCUMENTS

| | | | | |
|---|---|---|---|---|
| 3,631,381 | A * | 12/1971 | Pittman | 439/637 |
| 4,275,944 | A * | 6/1981 | Sochor | 439/267 |
| 5,634,819 | A * | 6/1997 | Pan et al. | 439/637 |
| 6,254,435 | B1 * | 7/2001 | Cheong et al. | 439/637 |
| 6,634,911 | B1 * | 10/2003 | Billman et al. | 439/884 |

FOREIGN PATENT DOCUMENTS

| | | |
|---|---|---|
| JP | 11-233183 | 8/1999 |
| JP | 2001-126791 | 5/2001 |

* cited by examiner

*Primary Examiner*—Hae Moon Hyeon
(74) *Attorney, Agent, or Firm*—IPUSA, PLLC

(57) ABSTRACT

A connector is disclosed that includes a housing having a space into which an object to be connected is inserted and a contact member incorporated in the housing. The contact member includes a first contact part and a second contact part. The first and second contact parts are aligned to come into contact with the pad of the object to be connected. The first contact part is positioned closer to the entrance of the space than the second contact part is. The first contact part and the second contact part face the space. The contact member includes a main body part, a first contact arm part having the first contact part, and a second contact arm part having the second contact part. The first contact arm part and the second contact arm part extend from first and second separate portions, respectively, of the main body part.

18 Claims, 12 Drawing Sheets

FIG.7B
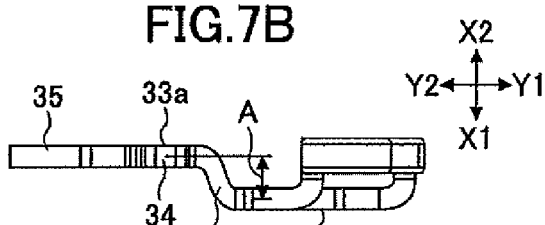
FIG.7D
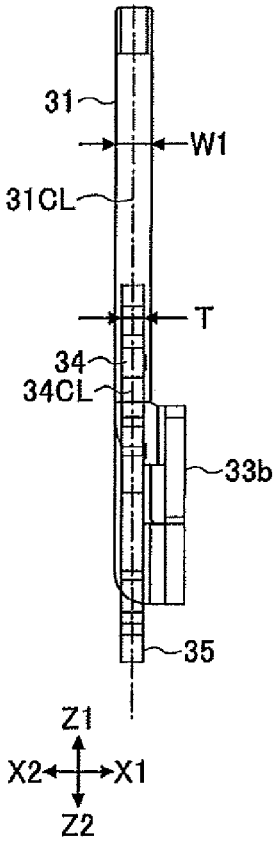
FIG.7A
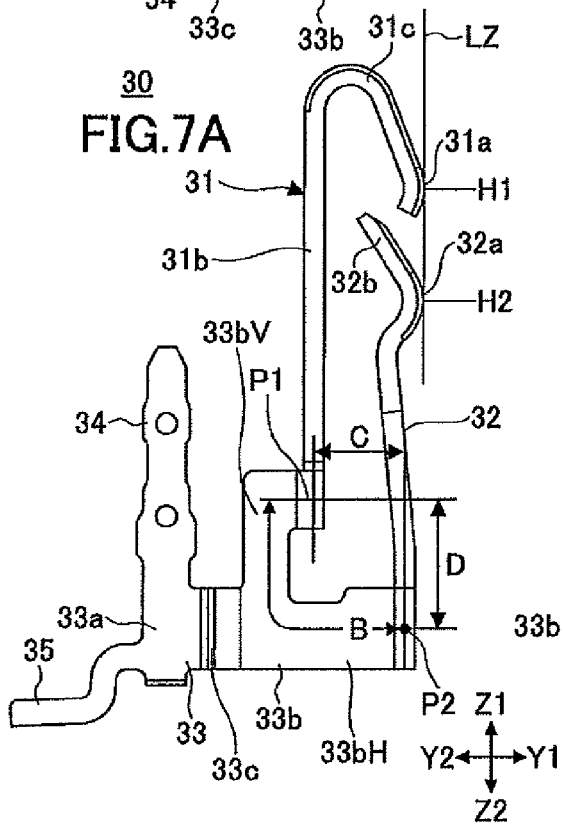
FIG.7C
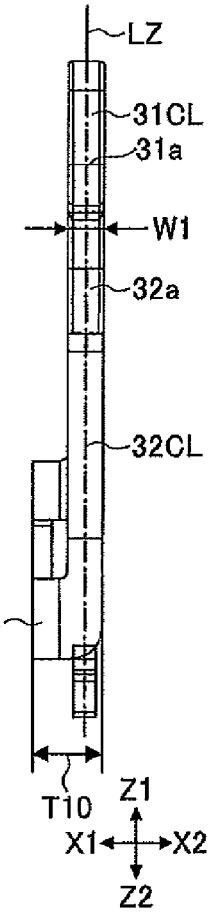
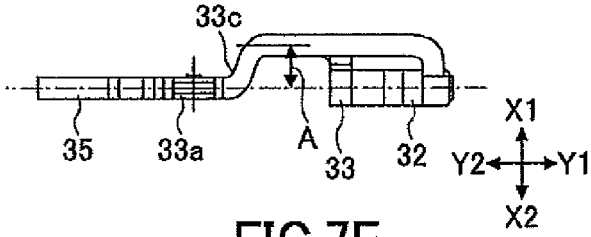
FIG.7E

CONTACT MEMBER HAVING MULTIPLE CONTACT PARTS AND CONNECTOR INCLUDING SAME

CROSS REFERENCE TO RELATED APPLICATIONS

The present application is based on Japanese Priority Patent Application No. 2008-037782, filed on Feb. 19, 2008, the entire contents of which are incorporated herein by reference.

BACKGROUND OF THE INVENTION

1. Field of the Invention

The present invention relates generally to connectors and contact members, and more particularly to a connector that allows an end part of an object to be connected to be inserted into and connected to the connector and to a contact member employed in the connector. The connector may be a card edge connector that is used in a server or RAID apparatus and allows an end part of a circuit board to be inserted into and connected to the connector.

2. Description of the Related Art

Inside apparatuses, multiple card edge connectors are arranged and mounted on a motherboard, and circuit boards such as DIMMs (Dual In-line Memory Modules) are inserted into and connected to corresponding card edge connectors so as to be arranged in a vertical position with respect to the motherboard. Here, the card edge connector is required to establish a highly reliable electrical connection with the circuit board.

In general, dirt or dust adhering to pads of the circuit board is the main cause of poor connections. Therefore, the card edge connector is required to establish a highly reliable electrical connection by cleaning the pads of the circuit board in such a manner as to rub the adhering dirt or dust away from the pads of the circuit board so that contact parts are pressed into contact with the cleaned parts.

For example, Japanese Laid-Open Patent Application No. 11-233183 and Japanese Laid-Open Patent Application No. 2001-126791 show conventional card edge connectors that intend to establish a reliable electrical connection with a cleaning function.

The card edge connector described in Japanese Laid-Open Patent Application No. 11-233183includes a contact member having two parts bent in a corrugated manner so as to have a first contact part and a second contact part arranged from the end side. The first contact part rubs dirt or dust away from a corresponding pad of the circuit board, and the second contact part comes into contact with the cleaned pad.

The card edge connector described in Japanese Laid-Open Patent Application No. 2001-126791 has a contact member divided into right and left lead parts by a slit extending in the longitudinal directions of the contact member so that a first contact part is formed on the left lead part and a second contact part is formed on the right lead part. The first contact part rubs dirt or dust away from a corresponding pad of the circuit board, and the second contact part comes into contact with the cleaned pad.

However, according to the card edge connector described in Japanese Laid-Open Patent Application No. 11-233183, if the first contact part deforms, the second contact part also deforms following the deformation of the first contact part. Thus, there is no independency between the first contact part and the second contact part. As a result, in particular, the contact pressure of the second contact part with the pad is subject to the deformation of the first contact part to become lower than an intended value, so that the reliability of electrical connection is reduced.

According to the card edge connector described in Japanese Laid-Open Patent Application No. 2001-126791, the independency between the first contact part and the second contact part is better than that of the configuration described in Japanese Laid-Open Patent Application No. 11-233183. However, the base of the right lead part and the base of the left lead part are extremely close to each other with only a slit therebetween. Accordingly, in some cases, a warp at the base of the left lead part may be transmitted to the base of the right lead part. Thus, there is not sufficient independency between the first contact part and the second contact part, so that the contact pressure of the second contact part with the pad may become lower than an intended value.

Further, there is a problem in that the card edge connector described in Japanese Laid-Open Patent Application No. 2001-126791 is difficult to use for currently used circuit boards. That is, the pad pitch is as narrow as approximately 1 mm in current circuit boards. However, this card edge connector has the right lead part and the left lead part arranged in its longitudinal directions, which prevents this card edge connector from accommodating narrow pad pitches of current circuit boards.

SUMMARY OF THE INVENTION

Embodiments of the present invention may solve or reduce one or more of the above-described problems.

According to one embodiment of the present invention, a connector in which one or more of the above-described problems may be solved or reduced and a contact member employed in the connector are provided.

According to one embodiment of the present invention, a connector is provided that includes a housing having a space into which an object to be connected is inserted and a contact member incorporated in the housing, the contact member including a first contact part and a second contact part aligned to come into contact with a pad of the object to be connected, wherein the first contact part is positioned closer to an entrance of the space than the second contact part is, the first contact part and the second contact part facing the space, and the contact member includes a main body part, a first contact arm part having the first contact part, and a second contact arm part having the second contact part, the first contact arm part and the second contact arm part extending from first and second separate portions, respectively, of the main body part.

According to one embodiment of the present invention, a contact member to be incorporated into a housing is provided that includes a main body part, a first contact arm part having a first contact part, and a second contact arm part having a second contact part, wherein the first contact part and the second contact part are aligned to come into contact with a pad of an object to be connected to the housing, the first contact part is positioned on an end side of the contact member opposite to the main body part relative to the second contact part, and the first contact arm part and the second contact arm part extend from first and second separate portions, respectively, of the main body part.

According to one aspect of the present invention, a first contact arm part having a first contact part and a second contact arm part having a second contact part extend from corresponding portions of a main body part separate from each other. Therefore, the second contact arm part is not affected by deflection of the first contact arm part, so that the first contact part and the second contact part are satisfactorily independent of each other. Accordingly, in any situation, the second contact part is enabled to come into contact with a corresponding pad of an object to be connected with a designed contact pressure (contact force).

BRIEF DESCRIPTION OF THE DRAWINGS

Other objects, features and advantages of the present invention will become more apparent from the following detailed description when read in conjunction with the accompanying drawings, in which:

FIGS. 7A through 7E are an X1-side view, a top plan (Z1-side) view, a Y1-side view, a Y2-side view, and a bottom plan (Z2-side) view, respectively, of the contact member according to the first embodiment of the present invention;

DETAILED DESCRIPTION OF THE PREFERRED EMBODIMENTS

A description is given below, with reference to the accompanying drawings, of embodiments of the present invention.

First Embodiment

Figure 1:
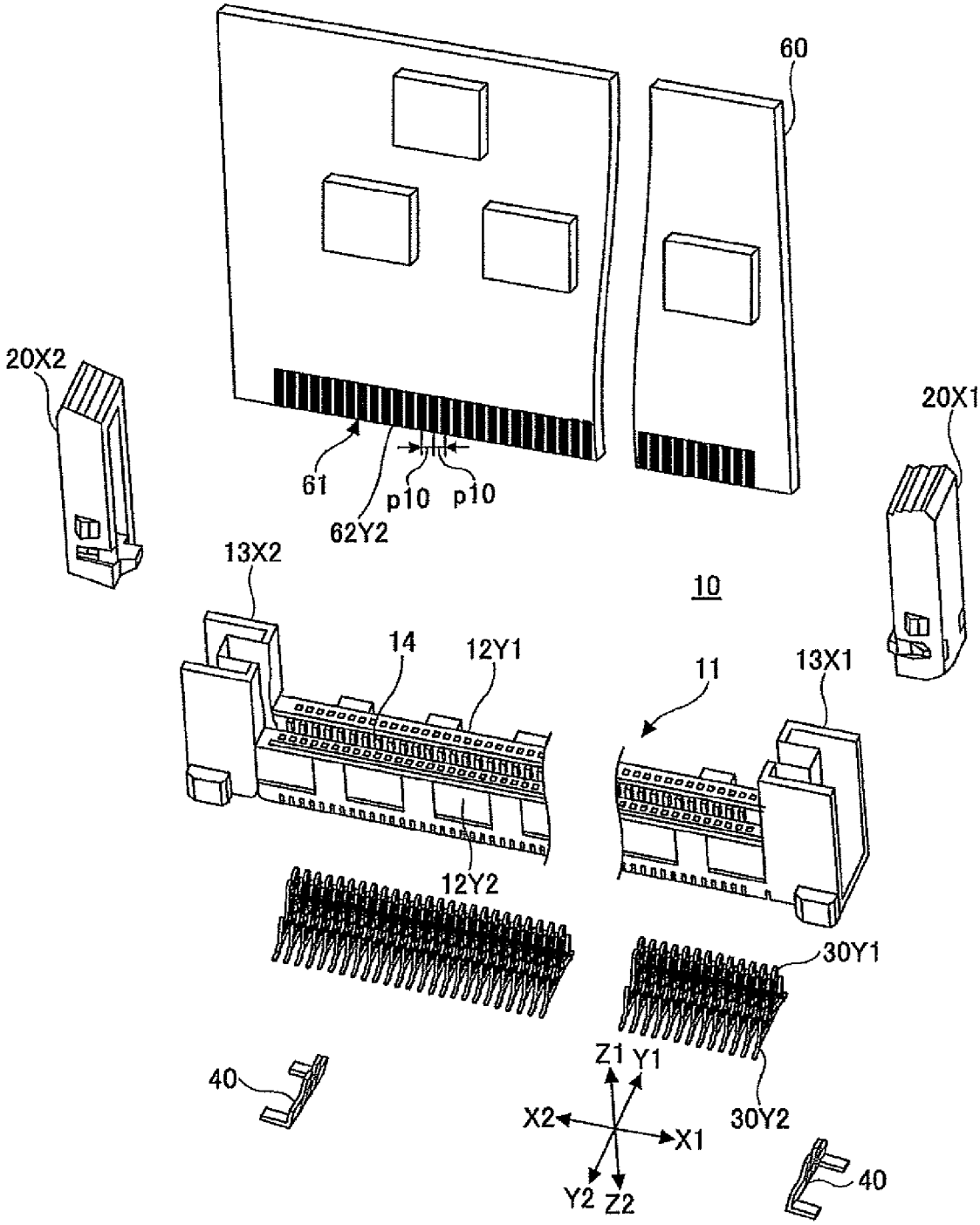
FIG. 1 is an exploded perspective view of a card edge connector according to a first embodiment of the present invention, in which the card edge connector is shown partially omitted together with a circuit board to be connected thereto.

FIG. 1 is an exploded perspective view of a card edge connector 10 according to a first embodiment of the present invention, in which the card edge connector 10 is shown partially omitted together with a circuit board 60 such as a DIMM to be connected thereto (an object to be connected thereto). In FIG. 1 and the following drawings, X1-X2, Y1-Y2, and Z1-Z2 indicate the lengthwise (longitudinal) directions, the widthwise directions, and the height (vertical) directions, respectively, of the card edge connector 10.

Figure 2:
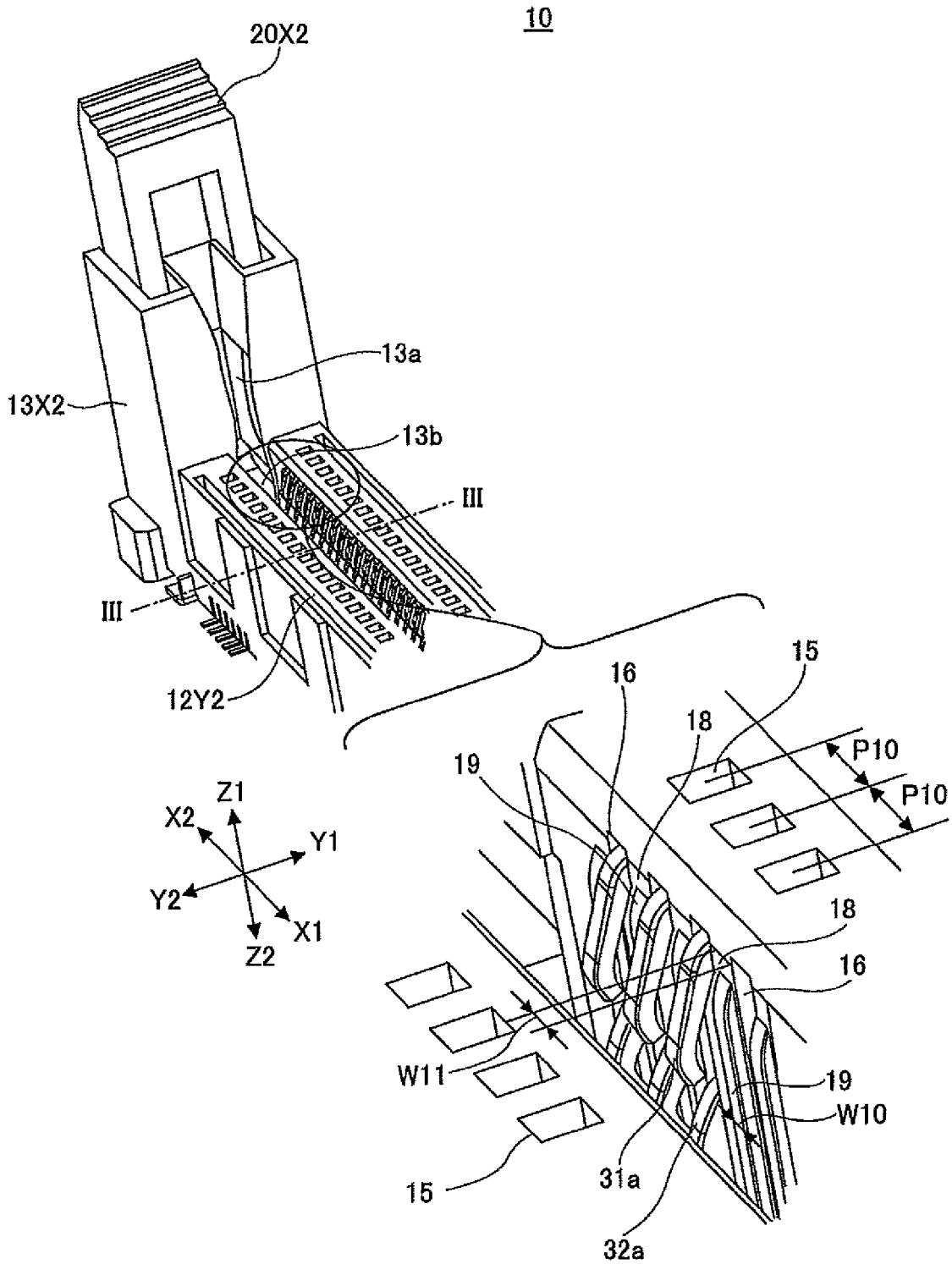
FIG. 2 is a partial blown-up perspective view of the card edge connector according to the first embodiment of the present invention, where the connector's X2-side end and its vicinity are shown enlarged.

FIG. 2 is a partial blown-up perspective view of the card edge connector 10, where the X2-side end thereof and its vicinity are shown enlarged.

Figure 3:
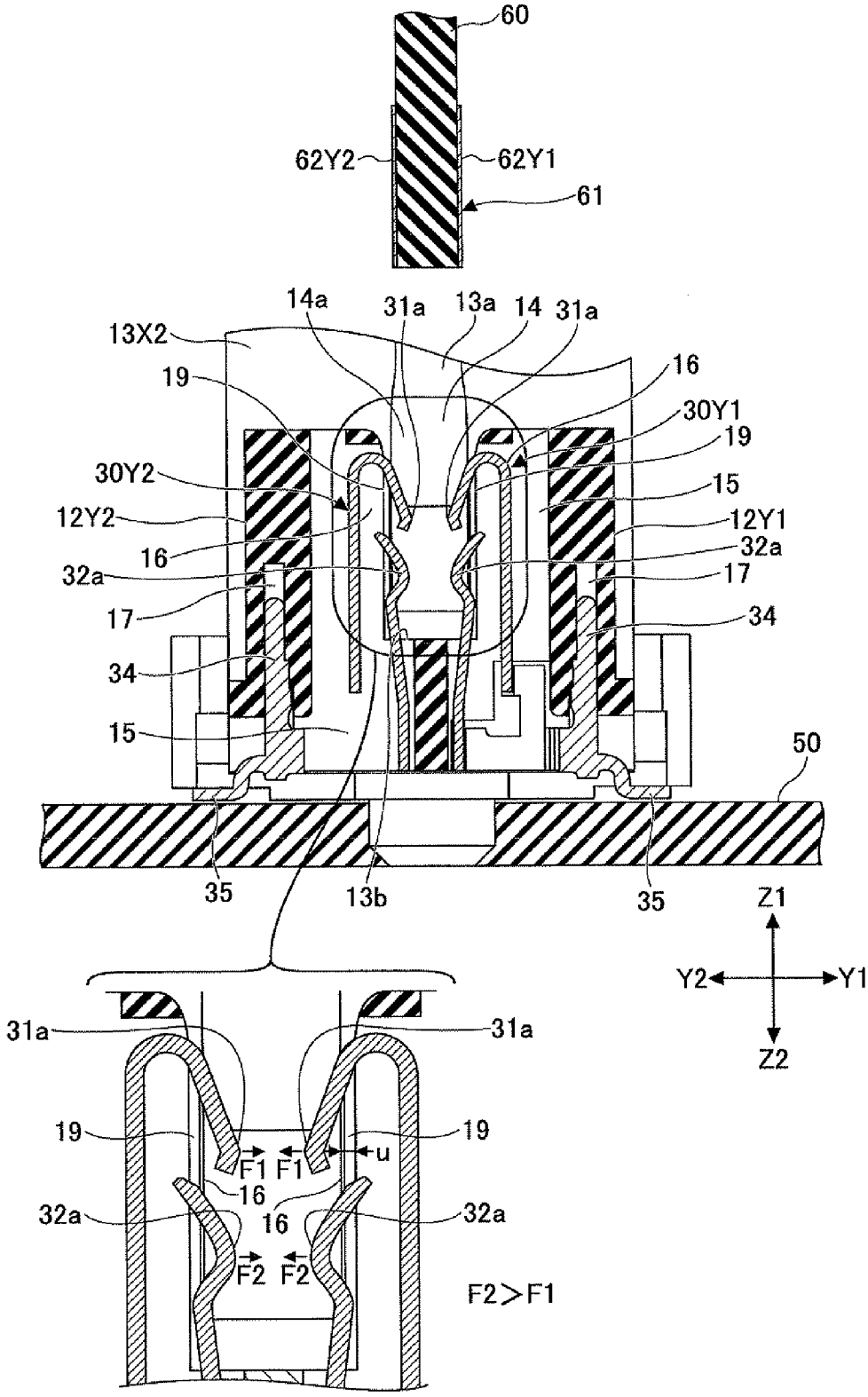
FIG. 3 is a blown-up cross-sectional view of the card edge connector taken along a perpendicular plane including line III-III of FIG. 2 according to the first embodiment of the present invention.

FIG. 3 is a blown-up cross-sectional view of the card edge connector 10 taken along a perpendicular plane including line III-III of FIG. 2.

Figure 4:
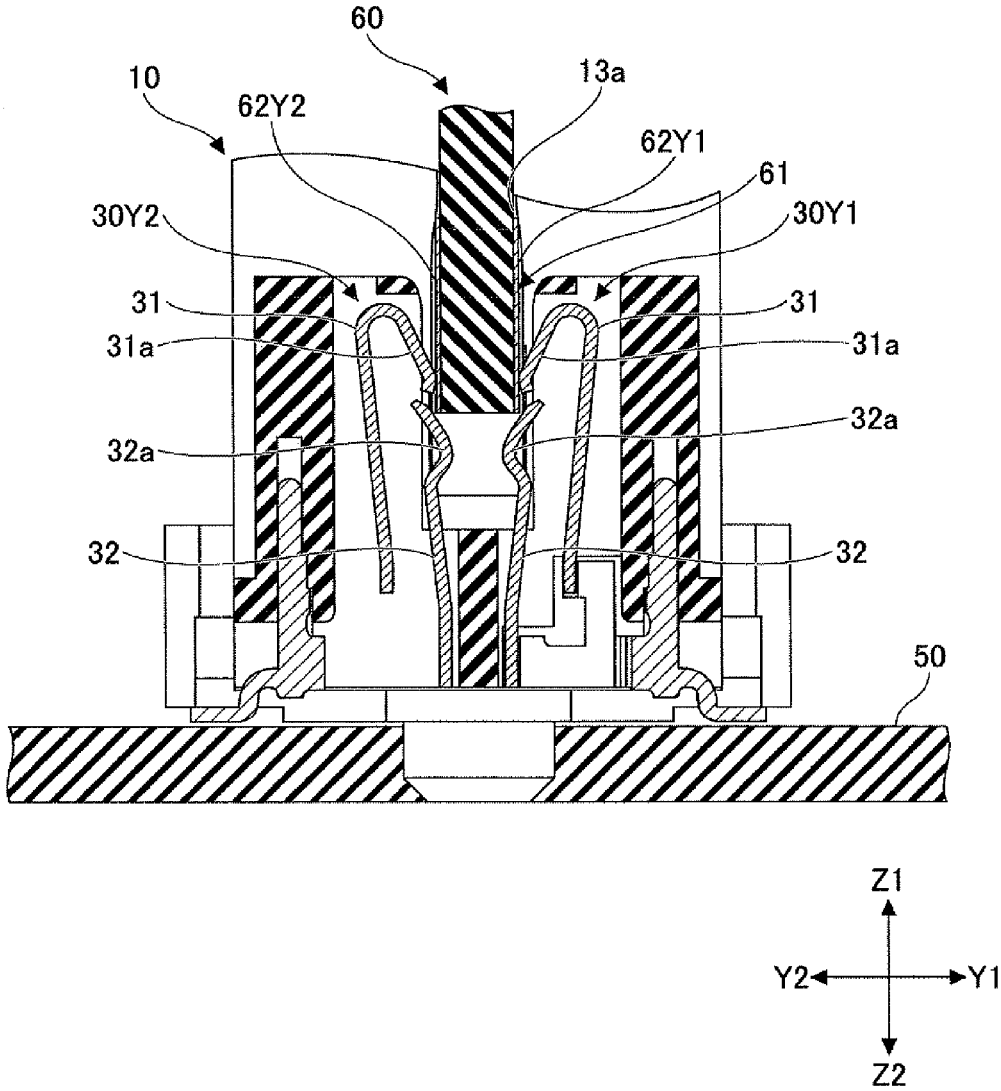
FIG. 4 is a diagram showing the circuit board inserted halfway into the card edge connector according to the first embodiment of the present invention.

FIG. 4 is a diagram showing the circuit board 60 inserted halfway into the card edge connector 10.

Figure 5:
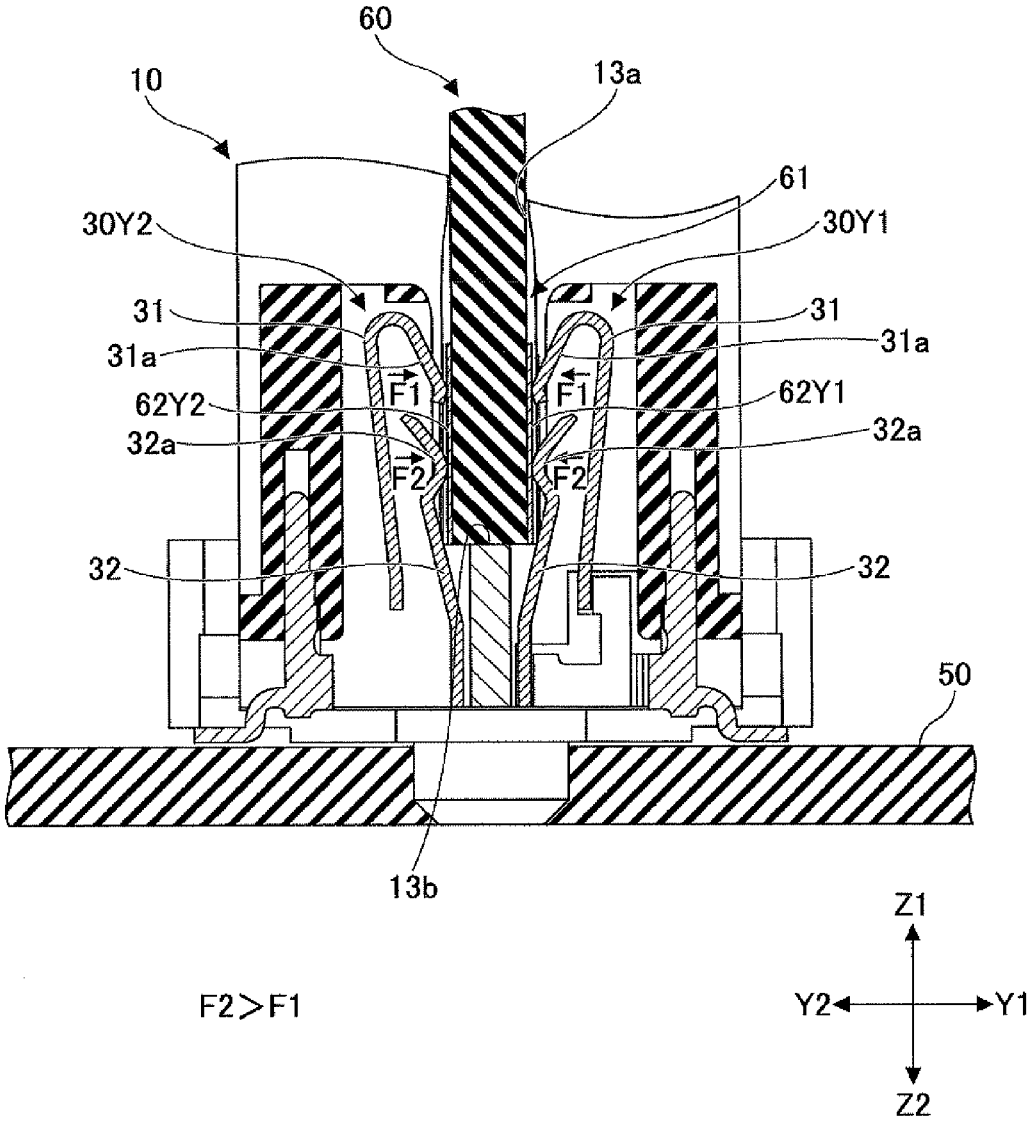
FIG. 5 is a diagram showing the circuit board connected to the card edge connector according to the first embodiment of the present invention.

FIG. 5 is a diagram showing the circuit board 60 connected to the card edge connector 10.

Referring to FIG. 1 through FIG. 3, the card edge connector 10 includes an elongated housing 11 formed of an insulator, hooks 20X1 and 20X2 provided at the corresponding lengthwise ends of the housing 11, multiple contact members 30Y1 and 30Y2 incorporated into the housing 11, and metal parts for mounting 40 fixed to the bottom surface of the housing 11.

The contact members 30Y1 and the contact members 30Y2 are arranged in alignment in the X1-X2 directions on the Y1 side and the Y2 side, respectively, in the housing 11 to face each other. The contact members 30Y1 and 30Y2 are the same members, and the suffix Y1 or Y2 is omitted in the case of describing a single contact member.

When in use, this card edge connector 10 is mounted on a motherboard 50, and a card edge part 61 at an end of the circuit board 60 having a memory IC device mounted on each surface is inserted into and electrically connected to the card edge connector 10. The card edge part 61 has pads 62Y1 and pads 62Y2 arranged with a pitch p10 (approximately 1 mm) on the corresponding sides (surfaces) of the circuit board 60.

[Structure of Housing 11]

Referring to FIG. 1 through FIG. 3, the housing 11, which has a quadrilateral frame shape elongated in the X1-X2 directions, includes elongated frame side parts 12Y1 and 12Y2 extending parallel in the X1-X2 directions and X1-side and X2-side columnar frame side parts 13X1 and 13X2. The elongated frame side parts 12Y1 and 12Y2 and the columnar frame side parts 13X1 and 13X2 may be referred to without the corresponding suffixes Y1, Y2, X1, and X2. A slot 14 is a space elongated in the X1-X2 directions in which the card edge part 61 of the circuit board 60 is to be inserted and accommodated. The slot 14 is formed in the center of the housing 11. The slot 14 has an entrance 14*a* through which the card edge part 61 is to be inserted on the Z1 side.

Referring to FIG. 1 through FIG. 3, the columnar frame side parts 13 project in the Z1 direction relative to the elongated frame side parts 12. A guide part 13*a* that guides and holds the corresponding end of the circuit board 60 to be connected and a stopper part 13*b* that determines the final insertion position of the circuit board 60 to be connected are formed inside each columnar frame side part 13.

Each elongated frame side part 12 has multiple slit-shaped openings (holes) 15 formed with the pitch p10 (approximately 1 mm) to extend in the Z1 direction from its bottom surface.

The contact members 30 are incorporated in the corresponding openings 15. Each opening 15 is flatly shaped along a Y-Z plane. Each opening 15 has a slit 16 communicating with the slot 14 on the center side of the housing 11 and has a press-fit hole 17 for press fit in a part near the exterior of the housing 11.

In the enlarged part in FIG. 2, graphical illustration of some contact arms is omitted in order to show the shape of the slits 16. As shown in the enlarged part in FIG. 2, each elongated frame side part 12 has the slits 16 arranged on its surface facing the slot 14 with a wall part 18 elongated in the Z1-Z2 directions between each adjacent two of the slits 16. Further, a projection 19 is formed on each wall part 18 to project on the slot 14 side by a small dimension u. The projections 19 have a width W10 smaller than the width W11 of the wall parts 18.

[Shape of Contact Member 30]

Figure 6:
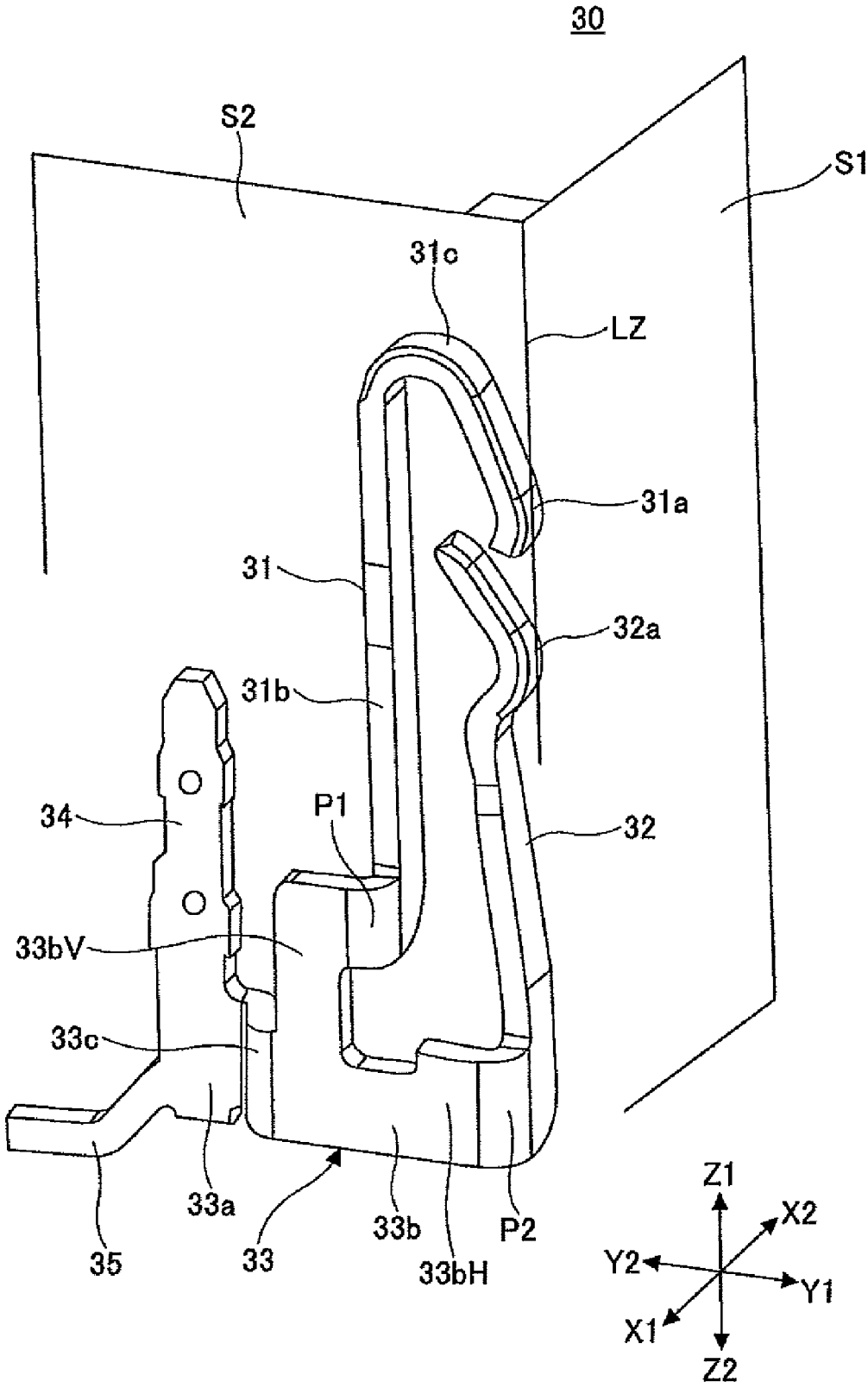
FIG. 6 is a perspective view of a contact member according to the first embodiment of the present invention.

FIG. 6 and FIGS. 7A through 7E show the contact member 30, which may be any of the contact members 30Y1 and 30Y2. FIG. 6 is a perspective view of the contact member 30. FIGS. 7A through 7E are an X1-side view, a top plan (Z1-side) view, a Y1-side view, a Y2-side view, and a bottom plan (Z2-side) view, respectively, of the contact member 30. For convenience of description, the position of the contact member 30 incorporated in the housing 11 is assumed to be a reference position.

The contact member 30 is manufactured by the press working of blanking out and bending a metal plate member having a thickness T. The contact member 30 includes a main body part 33, a first contact arm part 31, a second contact arm part 32, a bulge part 34, and a mounting terminal part 35. The contact member 30 is plated with gold (Au). The thickness of the main body part 33 and the thickness of the bulge part 34 correspond to the thickness T of the metal plate member that is original material.

The main body part 33 includes a first main body part 33*a* and a second main body part 33*b*, each of which is shaped like a Y-Z plane plate. The second main body part 33*b* is offset in the X1 direction by a dimension A relative to the first main body part 33*a* by a step part 33*c*. The second main body part 33*b* has an L-letter shape, and includes a vertical arm part 33*b*V and a horizontal arm part 33*b*H.

The bulge part 34 projects in the Z1 direction from the first main body part 33*a*. The mounting terminal part 35 projects in the Y2 direction from the first main body part 33*a*.

The first contact arm part 31 extends in the Z1 direction from an end part P1 of the vertical arm part 33*b*V of the second main body part 33*b*. The second contact arm part 32 extends in the Z1 direction from an end part P2 of the horizontal arm part 33*b*H of the second main body part 33*b*. That is, the first contact arm part 31 and the second contact arm part 32 extend from different (separate) portions of the main body part 33 spaced apart from each other by a distance B.

Each of the first contact arm part 31 and the second contact arm part 32 is bent at right angles in the X2 direction with respect to the second main body part 33*b*, and has a width W1.

The first contact arm part 31 includes an arm part 31*b* extending in the Z1 direction from the end part P1 and an inverse U-letter part 31*c* bent like an inverse U-letter shape in a clockwise direction in a view from the X1 side at the top of the arm part 31*b*. The first contact arm part 31 further includes a first contact part 31*a* at the end of a portion of the inverse U-letter part 31*c* which portion extends in the Z2 direction from the Z1 side. The first contact part 31*a* has its end bent inward, that is, bent to the Y2 side.

The second contact arm part 32 has a second contact part 32*a* in a portion near its end. A portion of the second contact arm part 32 nearer to its end than the second contact part 32*a* is positioned inside the inverse U-letter part 31*c* of the first contact arm part 31.

The first contact part 31*a* and the second contact part 32*a* are vertically positioned at different levels. In other words, the second contact part 32*a* is positioned at height H2, and the first contact part 31*a* is positioned at height H1 higher than height H2, that is, closer to the end side (Z1 side) than the second contact part 32*a*.

The first contact part 31*a* and the second contact part 32*a* are positioned on a line LZ in the Z1-Z2 directions.

The contact surfaces of the first contact part 31*a* and the second contact part 32*a* are the rolled surfaces of the metal plate member that is original material, so that the gold plating on the first contact part 31*a* and the second contact part 32*a* is less likely to be removed.

Further, the first contact arm part 31 and the second contact arm part 32 are designed so that the contact force F2 of the second contact part 32*a* is higher than the contact force F1 of the first contact part 31*a* (FIG. 3 and FIG. 5). For example, the contact force F1 of the first contact part 31*a* may be approximately 0.33 N, and the contact force F2 of the second contact part 32*a* may be approximately 0.46 N.

[Thickness T10 of Contact Member 30]

Next, a description is given of the thickness of the contact member 30.

Referring to FIG. 7C, a center line 31CL of the first contact arm part 31 and a center line 32CL of the second contact arm part 32 coincide in a view from the Y1 side. Referring to FIG. 7D, a center line 34CL of the bulge part 34 coincides with the center line 31CL of the first contact arm part 31. That is, the first contact part 31*a*, the second contact part 32*a*, and the bulge part 34 are positioned on a Y-Z plane S2 (FIG. 6) including the line LZ. Referring to FIG. 6, an X-Z plane S1 includes the first contact part 31*a* and the second contact part 32*a*. The main body part 33 is oriented to be positioned on the plane S2 that includes the line LZ and is perpendicular to the plane S1. As a result of this structure, the thickness T10 of the contact member 30 is approximately 0.75 mm, which is as small as approximately three times the thickness T of the metal plate member that is original material. This enables the contact members 30 to be aligned with a narrow pitch, that is, in an arrangement corresponding to the pitch p10 of the pads 62Y1 and 62Y2 of the circuit board 60.

[Independence of First Contact Part 31*a* and Second Contact Part 32*a*]

Next, a description is given of the independence of the first contact part 31*a* and the second contact part 32*a*.

The first contact arm part 31 extends in the Z1 direction from the end part P1 of the vertical arm part 33*b*V of the second main body part 33*b*. The second contact arm part 32 extends in the Z1 direction from the end part P2 of the horizontal arm part 33*b*H of the second main body part 33*b*.

Further, the distance measured along the second main body part 33*b* between the end part P1 and the end part P2 is the distance B. Further, the end part P1 and the end part P2 are distant from each other, being spaced apart by a dimension C (FIG. 7A) in the Y1-Y2 directions and by a dimension D in the Z1-Z2 directions.

The deflection of the base part of the first contact arm part 31 does not affect the second contact arm part 32, nor does the deflection of the base part of the second contact arm part 32 affect the first contact arm part 31.

Further, referring to FIG. 6, the arm part 31*b* is bent and the inverse U-letter part 31*c* is also bent in response to pressing the first contact part 31*a* in the Y2 direction. Accordingly, the bending (deflection) of the base part of the first contact arm part 31 is reduced by the deflection (bending) of the inverse U-letter part 31*c*. This configuration also serves to prevent the deflection of the base part of the first contact arm part 31 from affecting the second contact arm part 32.

Forming the inverse U-letter part 31*c* and providing the first contact part 31*a* thereon enable the base part of the first contact arm part 31 to be on the side close to the first main body part 33*a* on the second main body part 33*b*.

[Incorporation of Contact Member 30 into Housing 11]

The contact members 30 are inserted into the corresponding openings 15 from the bottom surface side of the housing 11 to be incorporated therein.

Each contact member 30 has its bulge part 34 press-fit and fixed to the corresponding press-fit hole 17 as shown in FIG. 3. Referring to FIG. 2 and FIG. 3, the inverse U-letter part 31*c* of the first contact arm part 31 and the second contact arm part 32 are fit in the corresponding slit 16 from the Z2 side. The first contact part 31*a* and the second contact part 32*a* project into the slot 14 from the corresponding slit 16.

Figure 8:
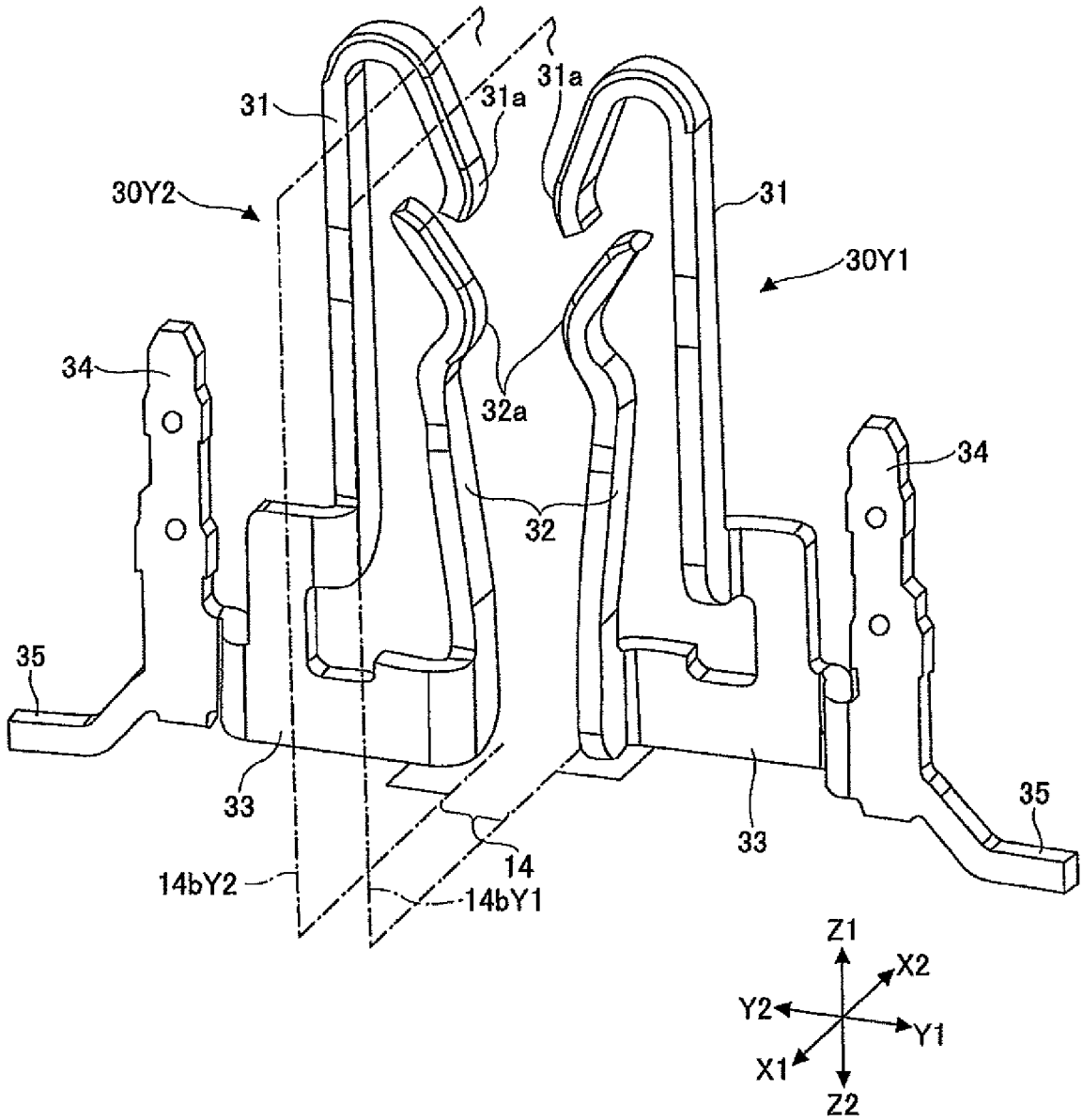
FIG. 8 is a diagram showing a pair of contact members in a face-to-face position in the card edge connector according to the first embodiment of the present invention.
Figure 9A:
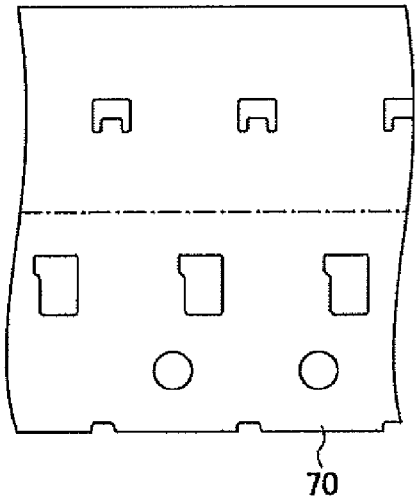
FIGS. 9A through 9D are diagrams showing a manufacturing process of the contact members according to the first embodiment of the present invention.
Figure 9B:
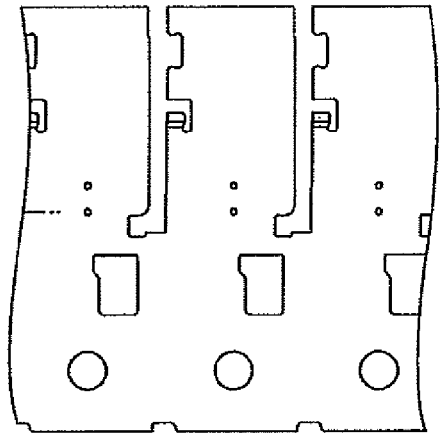
Figure 9C:
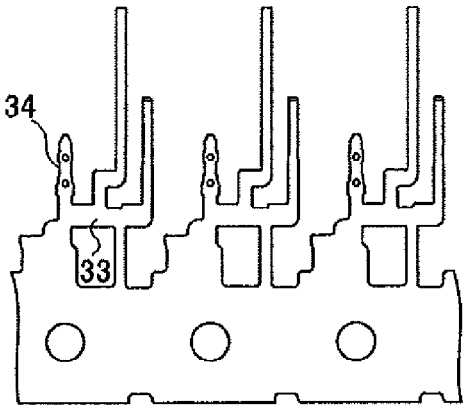
Figure 9D:
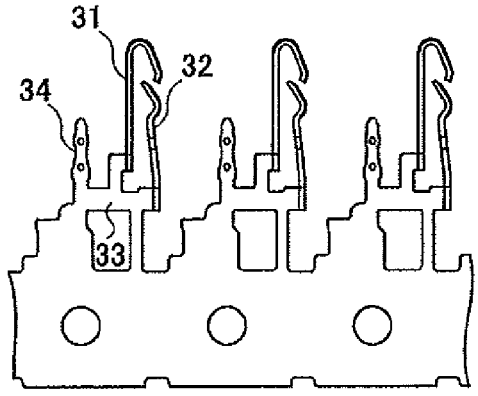

FIG. 8 is a diagram showing a pair of contact members 30 in a face-to-face position in the card edge connector 10.

As shown in FIG. 8, the contact member 30Y1 on the Y1 side and the contact member 30Y2 on the Y2 side face each other so that their first contact parts 31*a* face each other and their second contact parts 32*a* face each other. The main body parts 33 of the contact members 30Y1 and 30Y2 are positioned on a Y-Z plane, and are perpendicular to the lengthwise directions of the slot 14, that is, to wall faces 14*b*Y1 and 14*b*Y2 of the slot 14 (the surfaces of the wall parts 18).

The first contact arm part 31 has the inverse U-letter part 31*c* on the upper end side, and the second contact arm part 32 has its end positioned inside the inverse U-letter part 31*c* so as to be enclosed by the inverse U-letter part 31*c*. Thus, the contact member 30 has a rounded shape on the Z1 side so as not to catch on the corresponding opening during insertion. Accordingly, the contact member 30 is smoothly inserted into the corresponding opening 15 from the bottom surface side of the housing 11.

[Connection of Card Edge Connector 10 to Circuit Board 60]

Referring to FIG. 3, the card edge connector 10 is mounted on the motherboard 50 with the mounting terminal parts 35 of the contact members 30 being soldered to corresponding pads on the motherboard 50.

The card edge part 61 of the circuit board 60 is inserted into and connected to the card edge connector 10 as shown in FIG. 5 by way of the partially-inserted state shown in FIG. 4.

The circuit board 60 has its card edge part 61 inserted into the slot 14 through the entrance 14*a* with the end parts of the circuit board 60 being guided by the corresponding guide parts 13*a* as shown in FIG. 4.

The pads 62Y1 and 62Y2 first come into contact with the first contact parts 31*a* on the corresponding sides to elastically bend the first contact arm parts 31 outward. The first contact parts 31*a* rub the corresponding pads 62Y1 and 62Y2 to remove dirt from the pads 62Y1 and 62Y2, thereby cleaning the pads 62Y1 and 62Y2.

Here, in each contact member 30, the end part P1 and the end part P2 are distant from each other. Accordingly, the bending (deflection) of the first contact arm part 31 does not affect the second contact arm part 32. As a result, the second contact arm part 32 does not bend, so that the position of the second contact part 32*a* remains unchanged.

The circuit board 60 is further inserted until the circuit board 60 comes into contact with the stopper parts 13*b* (FIG. 5).

During this process, the pads 62Y1 and 62Y2 come into contact with the second contact parts 32*a* on the corresponding sides to elastically bend the second contact arm parts 32 outward.

The second contact parts 32*a* come into contact with the portions of the pads 62Y1 and 62Y2 cleaned by the first contact parts 31*a* with the contact force (contact pressure) F2.

Thus, each single pad (62Y1, 62Y2) is contacted by the corresponding contact member 30 at two points, that is, the first and second contact parts 31*a* and 32*a*. In particular, the second contact part 32*a* comes into contact with the cleaned part of the pad with the contact pressure (contact pressure) F2. Accordingly, the card edge part 61 of the circuit board 60 is electrically connected to the card edge connector 1 with high reliability.

Since each first contact arm part 31 has the inverse U-letter part 31*c* on its upper end side, the pads 62Y1 and 62Y2 smoothly come into contact with the corresponding first contact parts 31*a* and push them away toward the elongated frame side parts 12Y1 and 12Y2, respectively.

Further, the circuit board 60 has each end thereof held by the corresponding guide part 13*a* so as to be fixed steady. This configuration also increases the reliability of electrical connection.

Further, each of the first and second contact parts 31*a* and 32*a* has a rolled contact surface, so that the adhesive strength of the gold plating is high. Therefore, the gold plating is not removed (peeled off) even after the circuit board 60 is repeatedly connected and disconnected (attached and detached) multiple times. This also increases the reliability of electrical connection.

Here, consideration is given to how a force exerted on the first contact part 31*a* and the second contact part 32*a* (of each contact member 30) by the card edge part 61 of the circuit board 60 acts on the corresponding bulge part 34.

Referring to FIG. 6, the first contact part 31*a*, the second contact part 32*a*, the first contact arm part 31, the second contact arm part 32, and the bulge part 34 are positioned within the Y-Z plane S2 including the line LZ. Therefore, the force exerted on the first contact part 31*a* and the second contact part 32*a* by the card edge part 61 of the circuit board 60 acts on the center of the thickness of the bulge part 34. Therefore, no twisting force acts on the bulge part 34, so that the strength of fixation of the bulge part 34 in the corresponding press-fit hole 17 is not reduced and is maintained even after the circuit board 60 is repeatedly connected and disconnected multiple times. This also increases the reliability of electrical connection.

Even if the card edge part 61 of the circuit board 60 is warped, the bulging-side surface of the card edge part 61 only comes into contact with and scrapes the projections 19, and does not cause damage to the housing 11.

[Removal of Circuit Board 60 from Card Edge Connector 10]

The hooks 20X1 and 20X2 on corresponding sides are operated to be opened sideward and pulled down away from each other. This operation lifts up the circuit board 60 a little. Thereafter, the operator holds the circuit board 60 with fingers and pulls up the circuit board 60. As a result, the circuit board 60 is removed (detached) from the card edge connector 10.

[Manufacturing Process of Contact Member 30]

FIGS. 9A through 9D are diagrams showing a manufacturing process of the contact members 30.

Figure 10A:
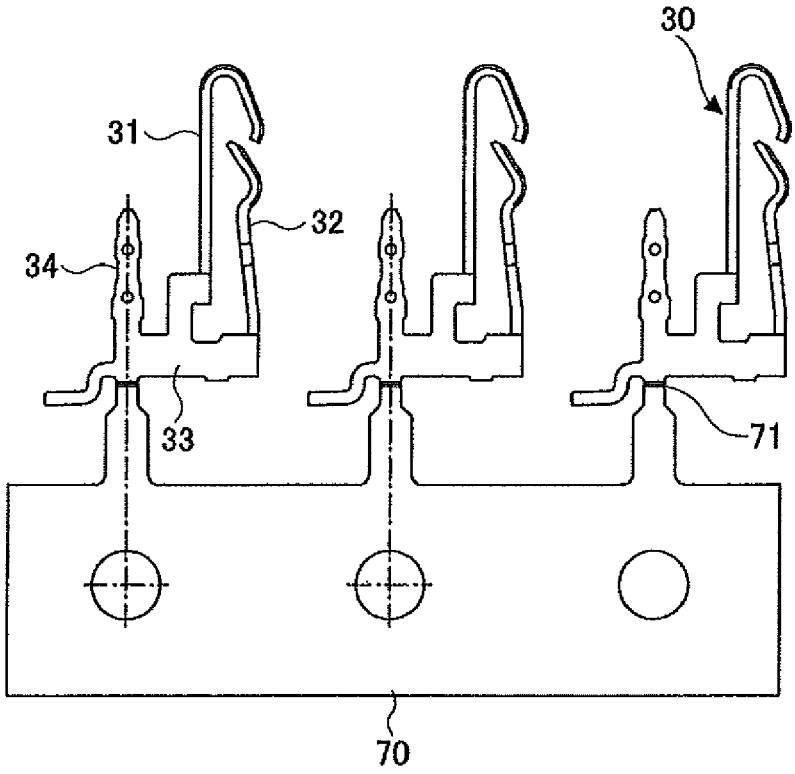
FIGS. 10A and 10B are diagrams showing the contact members after a final process of manufacturing according to the first embodiment of the present invention.
Figure 10B:
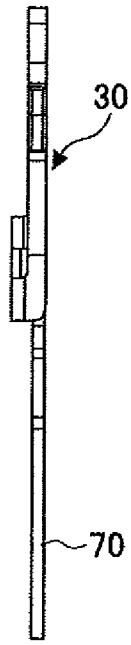

FIGS. 10A and 10B are diagrams showing the contact members 30 after a final process of manufacturing.

By performing press working on a roll-finished hoop material 70 step by step as shown in FIGS. 9A through 9D, the contact members 30 are manufactured, while remaining connected to a portion of the hoop material 70 as shown in FIGS. 10A and 10B.

The hoop material 70 is clamped and handled so that the contact members 30 are press-fit into the housing 11 to be broken at corresponding groove parts 71 and cut off from the remaining portion of the hoop material 70 one by one.

Second Embodiment

Figure 11:
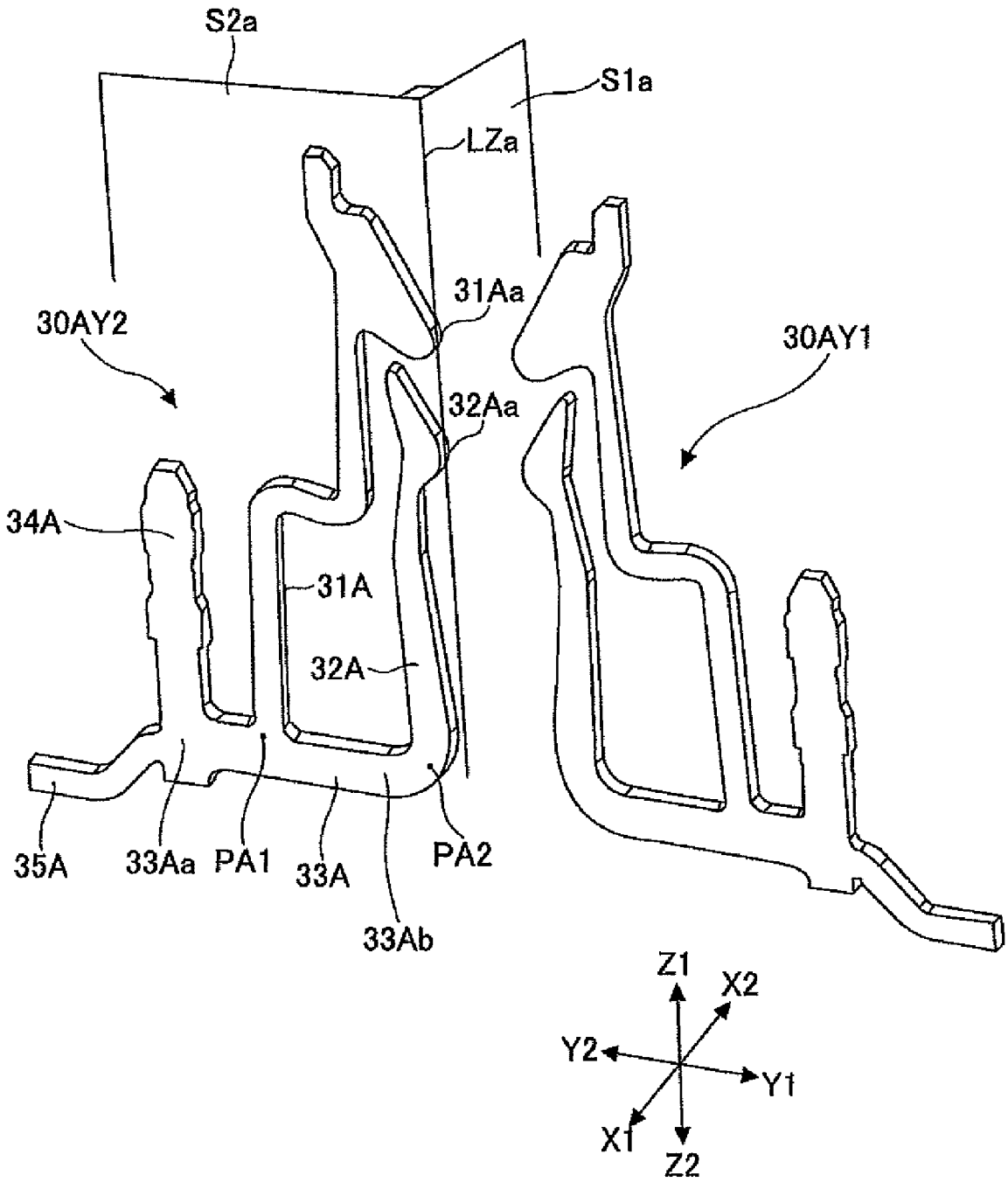
FIG. 11 is a diagram showing contact members according to a second embodiment of the present invention.

FIG. 11 is a diagram showing contact members 30AY1 and 30AY2 of a card edge connector in a face-to-face position according to a second embodiment of the present invention. The contact members 30AY1 and 30AY2 may be collectively referred to as the contact members 30A.

Each contact member 30A, which is shaped by simple blanking, includes a main body part 33A, a first contact arm part 31A, a second contact arm part 32A, a bulge part 34A, and a mounting terminal part 35A. Each contact member 30A is plated with gold. The first contact part 31A includes a first contact part 31Aa, which is a fractured surface. The second contact part 32A includes a second contact part 32Aa, which is a fractured surface. These contact members 30A are manufactured at low cost by single blanking.

The main body part 33A includes a first main body part 33Aa and a second main body part 33Ab. The bulge part 34A projects in the Z1 direction from the first main body part 33Aa. The first contact arm part 31A projects in the Z1 direction from a part PA1 of the second main body part 33Ab. The second contact arm part 32A projects in the Z1 direction from a part PA2 of the second main body part 33Ab. The part PA1 and the part PA2 are distant from each other so that the deflection of the first contact arm part 31A does not affect the second contact arm part 32A. Thus, the first contact arm part 31A and the second contact arm part 32A are independent of each other.

The first contact part 31Aa and the second contact part 32Aa are positioned on a line LZa in the Z1-Z2 directions. The main body part 33A is positioned on a plane S2*a* that includes the line LZa and is perpendicular to a plane S1*a* including the first contact part 31Aa and the second contact part 32Aa.

The contact members 30AY1 and 30AY2 are incorporated in alignment into a housing, so that a card edge connector is completed.

Third Embodiment

The present invention is applicable not only to card edge connectors but also to other types of connectors.

Figure 12:
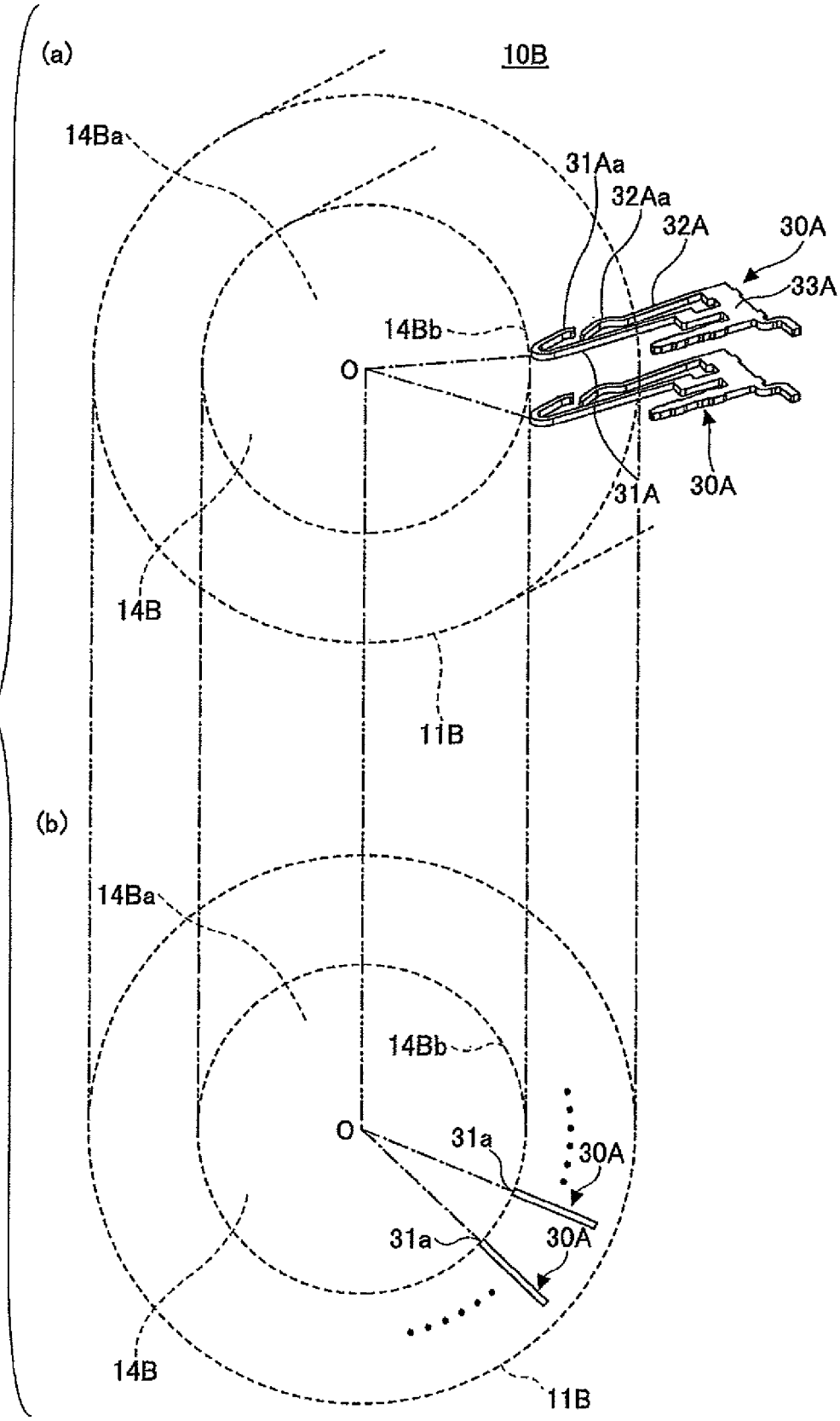
FIG. 12 is a diagram showing a cylindrical jack connector according to a third embodiment of the present invention.

FIG. 12 is a diagram showing a cylindrical jack connector 10B according to a third embodiment of the present invention. FIG. 12(*a*) is a perspective view showing part of the jack connector 10B, and FIG. 12(*b*) is a plan view of the jack connector 10B. For convenience of graphical representation, the jack connector 10B is shown by broken lines in FIG. 12.

The jack connector 10B includes a hollow cylindrical housing 11B and the contact members 30A of the second embodiment. The contact members 30A may be replaced with the contact members 30 of the first embodiment. The housing 11B has an inner wall face 14Bb that defines a cylindrical space 14B into which a plug connector (an object to be connected) is to be inserted through an entrance 14Ba. The contact members 30A are incorporated in the housing 11B in a radial arrangement with respect to the axis of the housing 11B passing through a center O of the entrance 14Ba, so that the main body parts 33A of the contact members 30A are perpendicular to the inner wall face 14Bb. The first and second contact parts 31Aa and 32Aa of each contact member 30A are aligned to come into contact with the same pad of the plug connector to be inserted.

According to one aspect of the present invention, a first contact arm part having a first contact part and a second contact arm part having a second contact part extend from corresponding portions of a main body part separate from each other. Therefore, the second contact arm part is not affected by deflection of the first contact arm part, so that the first contact part and the second contact part are satisfactorily independent of each other. Accordingly, in any situation, the second contact part is enabled to come into contact with a corresponding pad of an object to be connected with a designed contact pressure (contact force).

The present invention is not limited to the specifically disclosed embodiments, and variations and modifications may be made without departing from the scope of the present invention.

The present application is based on Japanese Priority Patent Application No. 2008-037782, filed on Feb. 19, 2008, the entire contents of which are hereby incorporated by reference.

What is claimed is:

1. A connector, comprising:

a housing having a space into which an object to be connected is inserted; and a contact member incorporated in the housing, the contact member including a first contact part and a second contact part aligned to come into contact with a pad of the object to be connected, wherein the first contact part is positioned closer to an entrance of the space than the second contact part is, the first contact part and the second contact part facing the space, the contact member includes a main body part, a first contact arm part having the first contact part, and a second contact arm part having the second contact part, the main body part including a first plate part, a second plate part, and a stepped plate part and the second plate part including first and second separate portions, the first and second contact arm parts are bent relative to the main body part and extend from the first and second separate portions, respectively, and the stepped plate part of the main body part connects the first and second plate parts thereof so that the first plate part is offset relative to the second plate part in a direction in which the first and second contact arm parts are bent relative to the main body part.

2. The connector as claimed in claim 1, wherein:

the main body part of the contact member further includes a bulge part press-fit into the housing, the bulge part extending from the first plate part of the main body part, the first contact arm part extends from the first portion of the second plate part of the main body part, the first portion being closer to the bulge part than the second portion is, and the second contact arm part extends from the second portion of the second plate part of the main body part, the second portion being on an end side of the main body part.

3. The connector as claimed in claim 1, wherein the first contact arm part and the second contact arm part of the contact member are bent at right angles in a same direction with respect to the main body part.

4. The connector as claimed in claim 1, wherein:

the main body part of the contact member further includes a bulge part press-fit into the housing, the bulge part extending from the first plate part of the main body part, and the contact member has the bulge part, the first contact arm part, and the second contact arm part blanked out front a metal plate member so that each of the first contact part and the second contact part has a rolled surface and that the first contact part, the second contact part, and the bulge part are positioned on a same plane.

5. The connector as claimed in claim 1, wherein the contact member is incorporated in the housing with the main body part being in a position perpendicular to a wall face of the space of the housing.

6. The connector as claimed in claim 1, wherein the housing has an elongated frame shape, and includes a guide part configured to guide and hold a corresponding end of the object to be connected on each of longitudinal end sides of the housing.

7. The connector as claimed in claim 1, wherein the first contact arm part and the second contact arm part are configured to have the second contact part come into contact with the pad of the object to be connected with a higher contact force than the first contact pad.

8. A connector comprising:

a housing having a space into which an object to be connected is inserted; and a contact member incorporated in the housing, the contact member including a first contact part and a second contact part aligned to come into contact with a pad of the object to be connected, wherein the first contact part is positioned closer to an entrance of the space than the second contact part is, the first contact part and the second contact part facing the space, the contact member includes a main body part, a first contact arm part having the first contact part, and a second contact arm part having the second contact part, the first contact arm part and the second contact arm part extending from first and second separate portions, respectively, of the main body part, the main body part of the contact member includes a bulge part press-fit into the housing on a base side of the main body part, the first contact arm part is formed by bending a portion of the main body part close to the bulge part at right angles with respect to the main body part, the second contact arm part is formed by bending a portion of the main body part on an end side thereof at right angles in a same direction as the first contact arm part with respect to the main body part, and the first contact arm part includes an inverse U-letter part on an end side thereof, the inverse U-left part being bent into an inverse U-letter shape so as to enclose an end of the second contact arm part, the first contact arm part having the first contact part in the inverse U-letter part.

9. The connector as claimed in claim 8, wherein:

the main body part of the contact member includes a stepped plate part bent near the bulge part to form a step with respect to the bulge part, and the first contact arm part and the second contact arm part are formed on the stepped plate part by bending the corresponding portions of the main body part at right angles to a same side as the bulge part.

10. The connector as claimed in claim 9, wherein:

the stepped plate part of the contact member has an L-letter shape including a horizontal arm part and a vertical arm part, the first contact arm part is formed by bending the corresponding portion of the main body part at an end of the vertical arm part, and the second contact arm part is formed by bending the corresponding portion of the main body part at an end of the horizontal arm part.

11. A contact member to be incorporated into a housing, the contact member comprising:

a main body part including a first plate part, a second plate part, and a stepped plate part, the second plate part including first and second separate portions;

a first contact arm part having a first contact part; and a second contact arm part having a second contact part, wherein:

the first contact part and the second contact part are aligned to come into contact with a pad of an object to be connected to the housing, the first contact part is positioned on an end side of the contact member opposite to the main body part relative to the second contact part, the first contact arm part and the second contact arm part are bent relative to the main body part and extend from the first and second separate portions, respectively, and the stepped plate part of the main body part connects the first and second plate parts thereof so that the first plate part is offset relative to the second plate part in a direction in which the first and second contact arm parts are bent relative to the main body part.

12. The contact member as claimed in claim 11, wherein:

the main body part father includes a bulge part to be press-fit into the housing, the bulge part extending from the first plate part of the main body part, the first contact arm part extends from the first portion of the second plate part of the main body part, the first portion being closer to the bulge part than the second portion is, and the second contact arm part extends from the second portion of the second plate part of the main body part, the second portion being on an end side of the main body part.

13. The contact member as claimed in claim 11, wherein the first contact arm part and the second contact arm part are bent at right angles in a same direction with respect to the main body part.

14. The contact member as claimed in claim 11, wherein:

the main body part futher includes a bulge part to be press-fit into the housing, the bulge arm extending from the first plate part of the main body part, and the bulge part, the first contact arm part, and the second contact arm part are blanked out from a metal plate member so that each of the first contact part and the second contact part has a rolled surface and that the first contact part, the second contact part, and the bulge part are positioned on a same plane.

15. The contact member as claimed in claim 11, wherein the first contact arm pad and the second contact arm part are configured to have the second contact part come into contact with the pad of the object to be connected with a higher contact force than the first contact part.

16. A contact member comprising:

a main body part;

a first contact arm part having a first contact part; and a second contact arm part having a second contact part, wherein:

the first contact part and the second contact part are aligned to come into contact with a pad of an object to be connected to the housing, the first contact part is positioned on an end side of the contact member opposite to the main body part relative to the second contact part, and the first contact arm part and the second contact arm part extend from first and second separate portions, respectively of the main body part, the main body part includes a bulge part press-fit into the housing on a base side of the main body part, the first contact arm part is formed by bending a portion of the main body part close to the bulge part at right angles with respect to the main body part, the second contact arm part is formed by bending a portion of the main body part on an end side thereof at right angles in a same direction as the first contact arm part with respect to the main body part, and the first contact arm part includes an inverse U-letter part on an end side thereof, the inverse U-letter part being bent into an inverse U-letter shape so as to enclose an end of the second contact arm part, the first contact arm part having the first contact part in the inverse U-letter part.

17. The contact member as claimed in claim 16, wherein:

the main body part includes a stepped plate part bent near the bulge part to form a step with respect to the bulge part, and the first contact arm part and the second contact arm part are formed on the stepped plate part by bending the corresponding portions of the main body part at right angles to a same side as the bulge part.

18. The contact member as claimed in claim 17, wherein:

the stepped plate part has an L-letter shape including a horizontal arm part and a vertical arm part, the first contact arm part is formed by bending the corresponding portion of the main body part at an end of the vertical arm part, and the second contact arm part is formed by bending the corresponding portion of the main body part at an end of the horizontal arm part.

* * * * *